US005908167A

United States Patent [19]

Provost

[11] Patent Number: 5,908,167

[45] Date of Patent: Jun. 1, 1999

[54] INTEGRATED HIGH PRESSURE DROP ROTATING THROAT FOR A COAL PULVERIZER

[76] Inventor: Robert S. Provost, 5630 Foxcross Pl., Stuart, Fla. 34997

[21] Appl. No.: 09/017,296

[22] Filed: Feb. 2, 1998

[51] Int. Cl.[6] ..... B02C 15/00

[52] U.S. Cl. ..... 241/119; 29/401.1

[58] Field of Search ..... 241/119; 29/401.1, 29/402.08, 402.09, 402.11

[56] References Cited

U.S. PATENT DOCUMENTS

| | | | |
|---|---|---|---|
| 4,264,041 | 4/1981 | Kitto et al. | 241/57 |
| 4,687,145 | 8/1987 | Dougan et al. | 241/57 |
| 4,721,258 | 1/1988 | Dougan et al. | 241/57 |
| 4,874,135 | 10/1989 | Provost | 241/57 |
| 5,020,734 | 6/1991 | Novotny | 241/119 |
| 5,127,590 | 7/1992 | Bunton | 241/119 |
| 5,263,655 | 11/1993 | Giammaruti et al. | 241/119 |
| 5,263,855 | 11/1993 | Watson et al. | 241/119 |
| 5,340,041 | 8/1994 | Henning et al. | 241/119 |
| 5,549,251 | 8/1996 | Provost | 241/119 |
| 5,667,149 | 9/1997 | Eisinger | 241/18 |

*Primary Examiner*—Joseph J. Hail, III
*Assistant Examiner*—Susan R. Kingsbury
*Attorney, Agent, or Firm*—William L. Krayer

[57] ABSTRACT

A rotatable throat for a coal pulverizer is improved by creating a high pressure drop in the air ports which surround the throat. The lower portions of the air port nozzles are made of vanes and relatively thin sides, and shaped to provide air entrance areas from five to six times the release points of the nozzles.

8 Claims, 5 Drawing Sheets

INTEGRATED HIGH PRESSURE DROP ROTATING THROAT FOR A COAL PULVERIZER

TECHNICAL FIELD

This invention relates to pulverizers, particularly as are designed for use in pulverizing coal for power generation and the like. The invention comprises an integrated, high pressure drop, rotating throat for such pulverizers.

BACKGROUND OF THE INVENTION

In an important aspect, this invention is an improvement on that described in my U.S. Pat. No. 5,549,251. The new rotating throat described and claimed herein has significantly less mass than previous throats, replaces the lower part of the prior art throat with a series of vanes of a particular shape, and provides an overall restricted air passage area through the throat in order to generate a high pressure drop rather than a low pressure drop as is conventional.

The present invention applies to various types of roll-and-ring grinding mills which are air swept and utilize a vertical spindle. Roll-and-ring grinding mills have a circular track, groove or grinding table in which the heavy rolls contact the coal. Surrounding the grinding table is a series of air ports collectively known as a throat, through which air is forced to move the particulate coal upwards to a classifier.

As mentioned in my earlier U.S. Pat. No. 5,549,251 (col. 2 lines 24–34), primary air performs four functions in the pulverizer: (1) drying of the coal in the pulverizer, (2) maintaining a fluidized bed of coal, which circulates coal into the path of the grinding elements, (3) transporting the coal particles from the fluidized bed into the classifier assembly, where large particles are separated for return to the grinding elements, and (4) transporting suitably pulverized coal particles out of the classifier to the burners.

Separation of the smaller and larger coal particles and recycling of the larger ones is common to most if not all pulverizer designs. The task is complicated, however, by the presence of relatively dense non-combustible materials, i.e. rock which is incidentally introduced as part of the coal feed. Where the machine functions actually to recycle such materials rather than separating them out, the inefficiency is manifest. The machine not only expends unnecessary energy on recirculating and regrinding a material of zero fuel value, but does so at the cost of considerable wear. If somehow the rock particles are not rejected from the coal being processed, they must be reduced in size until they can mix with the coal particles transported to the burners. The presence of rock particles in the fuel stream reduces combustion efficiency and also results in a greater and faster buildup of ash in the combustion chamber, further reducing boiler efficiency by retarding heat transfer from the combustion chamber.

Kitto and Kowalski, in U.S. Pat. N0. 4,264,041, describe a construction of a Babcock and Wilcox pulverizer throat said to provide a low pressure drop, which they associate with reduced erosion and improved air flow distribution. They use a particular ratio of curvatures of the inlets and outlets of the throat to the radial width of the throat to effect a reduction or deceleration of air flow through the outlet of the throat in order to "minimize dribble" (claim 1) of solid material through the throat. The Kitto et al construction and other similar designs providing low pressure drops particularly in the throat outlet are widely used but have demonstrated difficulty in controlling foreign substances such as rock which can cause excessive erosion of the pulverizer parts and reduced efficiency due to the unwanted processing of the rock particles. In general, throats with low pressure drops fail to create a jet of air sufficiently energetic to prevent coal from being rejected and thus require volumes of air greater, frequently substantially greater, than the typical nominal 2:1 weight ratio to coal.

SUMMARY OF THE INVENTION

Contrary to the Kitto et al (4,264,041) approach, my invention seeks to increase or maximize the velocity of the air stream through the throat while minimizing or reducing its volume. I have found that doing so according to my design will not result in excessive erosion.

My design incorporates two notable features—a long radial sweep for the air inlet nozzles imposed on the inside and outside walls of the inlet passages rather than the radial sides, and a relatively small total area at the "release points" of the nozzle orifices, to maximize the effects of the jet configuration of the nozzle, and to provide a high pressure drop.

DETAILED DESCRIPTION OF THE INVENTION

Figure 1:
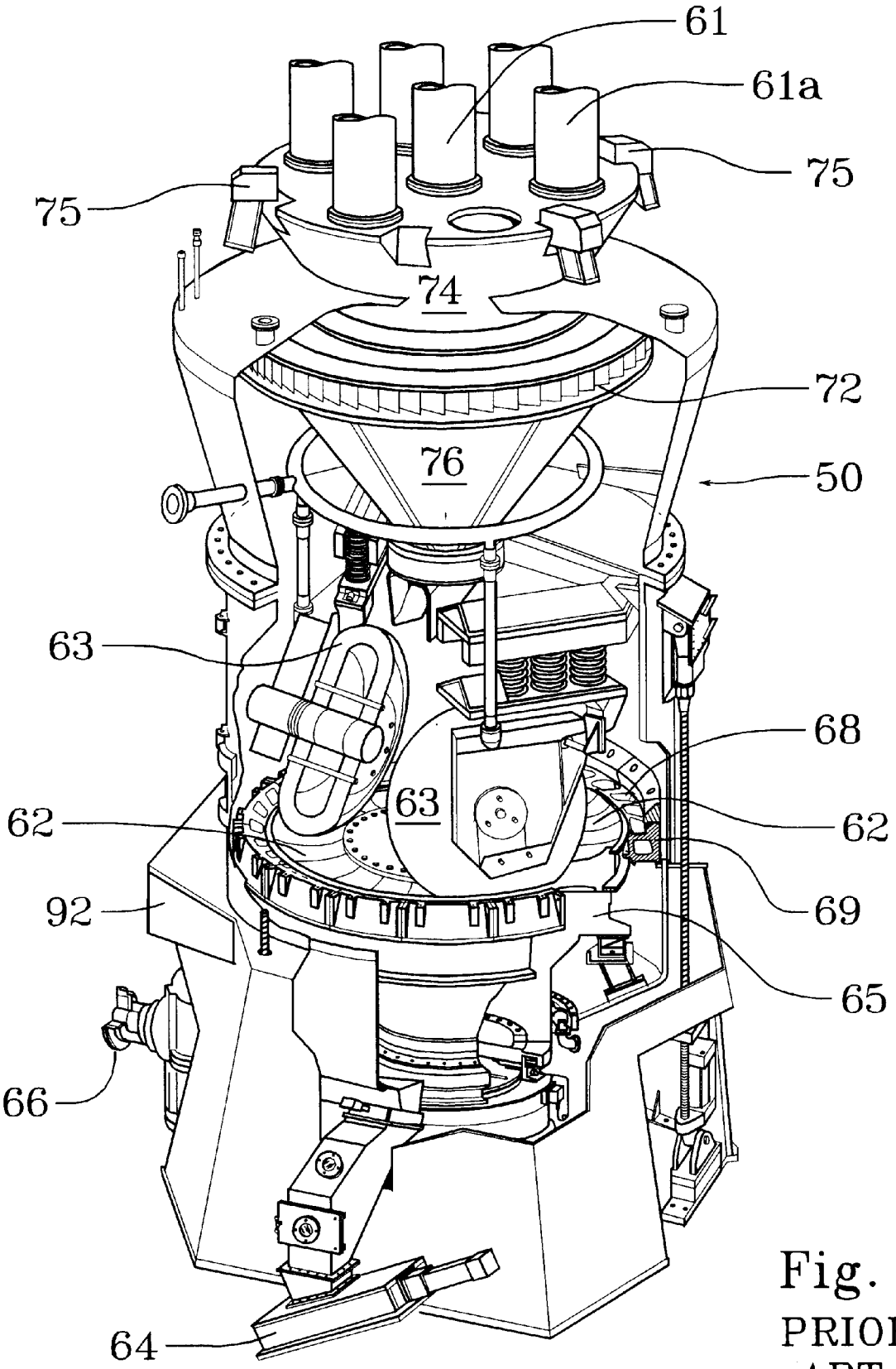
Fig. 1 PRIOR ART
FIG. 1 is a perspective view of a prior art pulverizer assembly, showing the position of the throat and the air passages through it.

The overall design of FIG. 1 is generally of a prior art Babcock and Wilcox pulverizer model MPS 89. Raw coal is fed into the top of the pulverizer 50 through the raw coal pipe 61 and descends to the grinding ring 62 where it is broken by grinding wheels 63. The grinding ring 62 has a base or yoke 65 turned by a motor shaft 66, resulting in the rotation of the grinding wheels 63 on the grinding ring 62. The pulverized coal is centrifugally thrust by the rapid turning of the grinding ring across air channels 68 of throat ring 69. Throat ring 69 concentrically surrounds the coal grinding assembly such that all of the pulverized coal passes over the throat ring 69 and the air channels 68 in particular.

Forced air is supplied through air inlet 92 to and through the air channels 68 of the throat ring 69 at a rate of flow to create an air/coal flow as high as 3000 pounds per minute through all the air channels 68. It should be noted here that this description relates mainly to a pulverizer (the B&W MSP 89, in this case) having a usual or typical processing capacity of 50, 60, or 70tons of coal per hour, although the manufacturer rates the capacity as 35–75 tons per hour for coals ranging from 50 Hargrove hardness and 12% moisture to 90 Hargrove hardness, 5% moisture. In such a pulverizer, the total area at the release point of all the air channels 68, for prior art mills, will be in the range of 900 to 1500 square inches. One of the innovative features of my invention is to reduce this total area (in the MPS 89, for example) to the range of 800 or less square inches, generally about 650 to about 800 square inches, while maintaining the capacity to handle the amount of air necessary to move the same amounts of pulverized coal from the lower regions of the pulverizer upwards to the classifier 72. The function of the classifier 72 is to segregate the coal which is fine enough to be burned from that which must be returned to the pulverizer because it is still too large. The relatively fine coal is carried with the air to the boiler through discharge turret 74 and burner pipes 61*a*, partially controlled by burner pipe valves 75, while the recycled larger particles fall back to the grinding ring 62 by way of classifier cone 76. Relatively dense mineral particles hopefully will find their way to "pyrites box" 64.

Reduction of the total release point area of the air channels 68 according to my invention brings about a high pressure drop, which reduces the volume of air passing through the air channels 68 while increasing its velocity. Contrary to what one might expect, I have found that increasing the velocity of a reduced volume of air at this point actually reduces erosion of the air channels 68 rather than increasing it. However, it should be noted that I have combined this innovation with a particular approach to achieving the high pressure drop.

Figure 2:
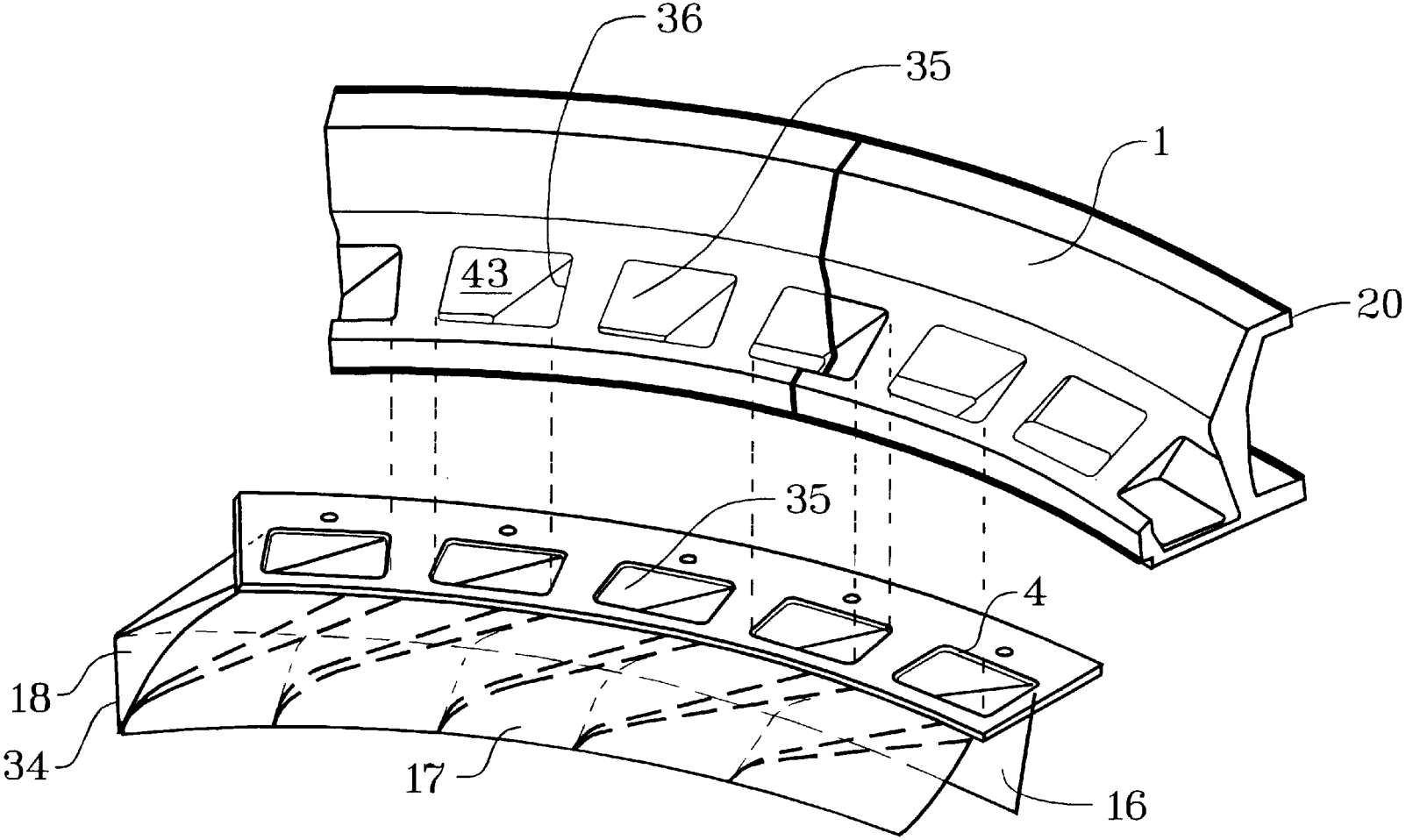
FIG. 2 is a perspective view of a segment of the new throat.

FIG. 2 depicts a wear resistant cast steel segment 1 of the throat which is modified in several ways from the prior art. First, it is considerably less massive, since I have in effect eliminated the traditional lower two thirds or so of the cast steel segment and replaced it with fabricated steel vanes 18 since I have found that with my design erosion wear is limited to only the upper one-third of the throat. The throat segment 1 is shown separated from the lower portion attached to it to form air channels 35 which take the place of air channels 68 of FIG. 1. The two parts are shown assembled in FIG. 4. Vanes 18, outer air inlet skirts 16, and inner air inlet skirts 17 form the lower ends of the air channels 35, continuing more or less in the same orientation providing a smooth passageway upwardly to release point 36 and comprising the bulk of the converging nozzles necessary to create a high jet velocity at low total air volumes. Second, I have constricted the upper portion of the air channels 35 by designing a restriction into the air channels 35 between the inside wall 14 (see FIGS. 3 and 4) and outside wall 43. The outside wall 43 of channel 35 is generally conical and inclined toward the center of the pulverizer by about 15 to 19 degrees. I have restricted the area across release orifice 36 to cause a considerable pressure drop in channel 35.

Generally the throat segments 1 will define about 42 converging nozzles (release points 36); this is not an essential number, however, and other numbers may be found to be useful, i.e. perhaps from about 36 to about 48 or more. The usual target is to maintain an air to coal weight ratio of about 2/1; I am able to maintain the air/coal ratio comfortably at less than that, generally around 1.85:1, or in the range of about 1.8:1 to about 1.9:1, or less than 1.8:1.

The coal containment ring 20 portion of my throat segment 1 above the outside wall 43 of channel 35 comprises the upper portion of the throat. Its function is to retain the coal in the working area of the pulverizer, and, being an integral portion of the segment 1, will rotate with the throat. The profile of the coal containment ring 20 portion of segment 1 enables me to eliminate the ledge covers of the prior art, either fixed to the inner wall of the pulverizer or fixed to rotating segments.

Figure 3:
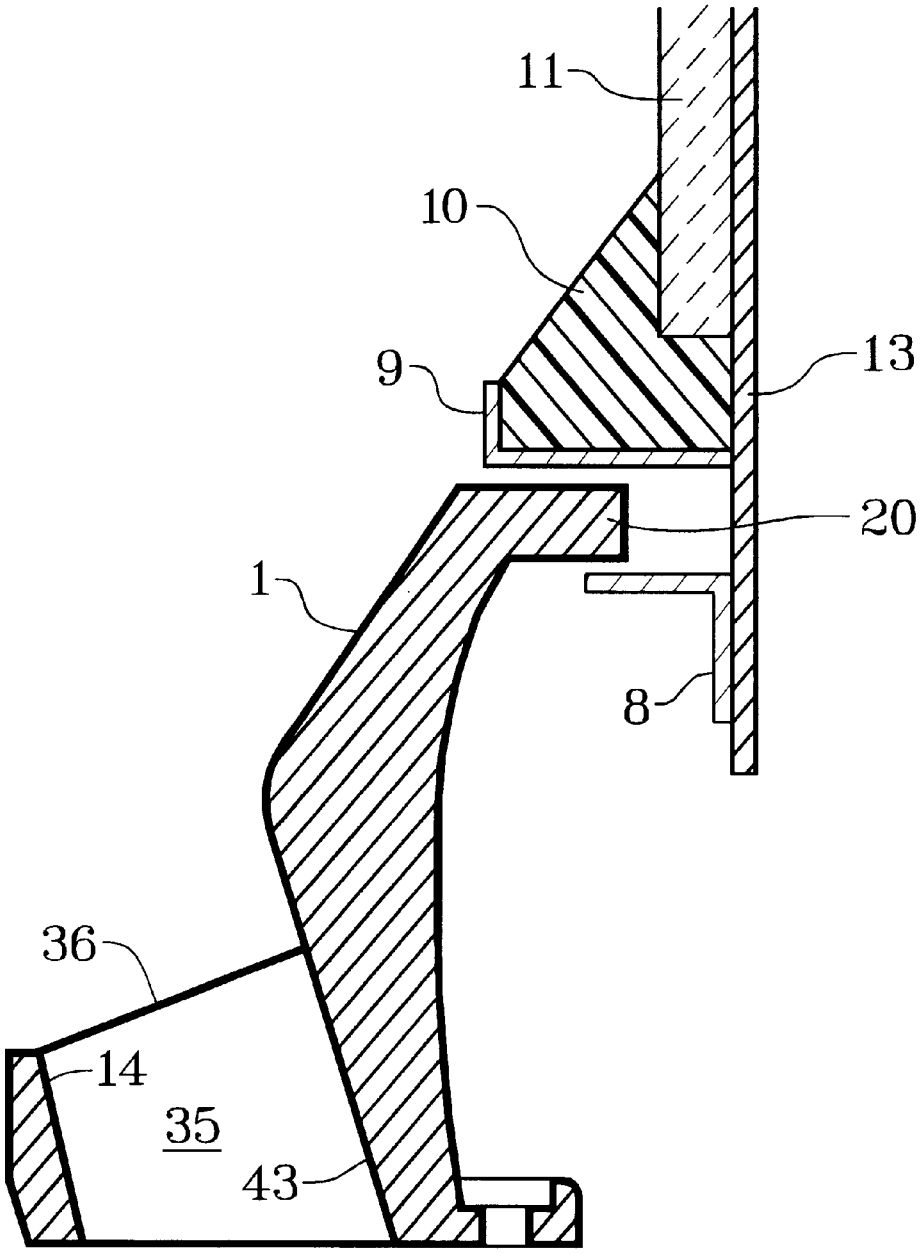
FIG. 3 is a sectional view of my new segment, showing its relationship to the internal wall of the pulverizer.

As seen in FIG. 3, the upper portion of segment 1 shown in FIG. 3 includes an air seal in combination with the inner wall of the pulverizer. The air seal includes a lower air seal ledge 8 and an upper air seal ledge 9. Behind upper air seal ledge 9 is a circumferential filler 10 of ceramic epoxy resin, and ceramic tile 11, fixed to lining 13 of the pulverizer. Coal containment ring 20 protrudes into the area between upper air seal ledge 9 and lower air seal ledge 8, with sufficient clearance to allow free rotation with segment 1. This arrangement provides a tortuous path for any primary air attempting to bypass the air ports in the throat, thereby minimizing such inefficient bypassing.

Figure 4:
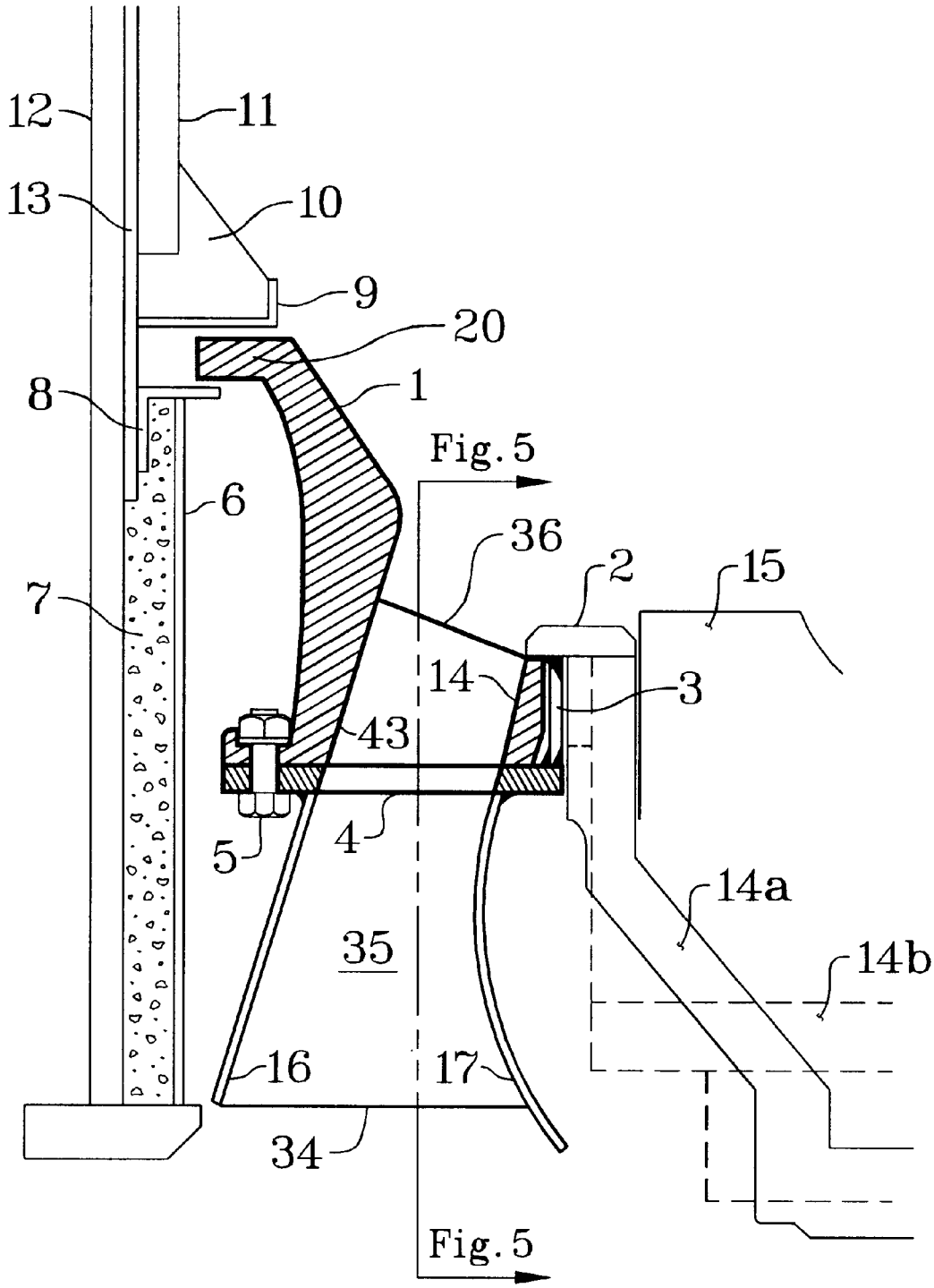
FIG. 4 is a sectional view of the installed segment showing the inner and outer walls of the air inlet skirt.

FIG. 4 shows the thermal insulation 7, which may be of refractory or other durable material, between pulverizer wall 12 and barrel liner 6 that may be installed in pulverizers operating with high inlet air temperatures required when processing high moisture coals. The function of the thermal insulation 7 is to increase the overall thermal efficiency of the pulverizer by decreasing heat losses to the surrounding air. Outer air inlet skirt 16 is a conical section placed at about 17° from the vertical, and inner air inlet skirt 17 is a spherical section so that the contained volume has a sweeping curve shape gradually widening to the opening of the air inlet 34. The width of the air channel 35 gradually decreases upwardly from about 3900 square inches at the air inlet 34 to about 650 to 800 square inches, or about one-fifth to about one-sixth the area, at the release point 36. The entire assembly is attached either by welding or by bolts 5 to mounting ring 4 which in turn is fastened through mounting ring extension plate 3 and ring seat cap plate 2 to a grinding ring seat which uses parts of the rotating grinding table and grinding ring segment. The grinding ring seat may be either a single-piece casting 14*a* or a weldment 14*b* and contains a plurality of grinding segments 15 that form the circular track in which the heavy rolls contact the coal.

Figure 5:
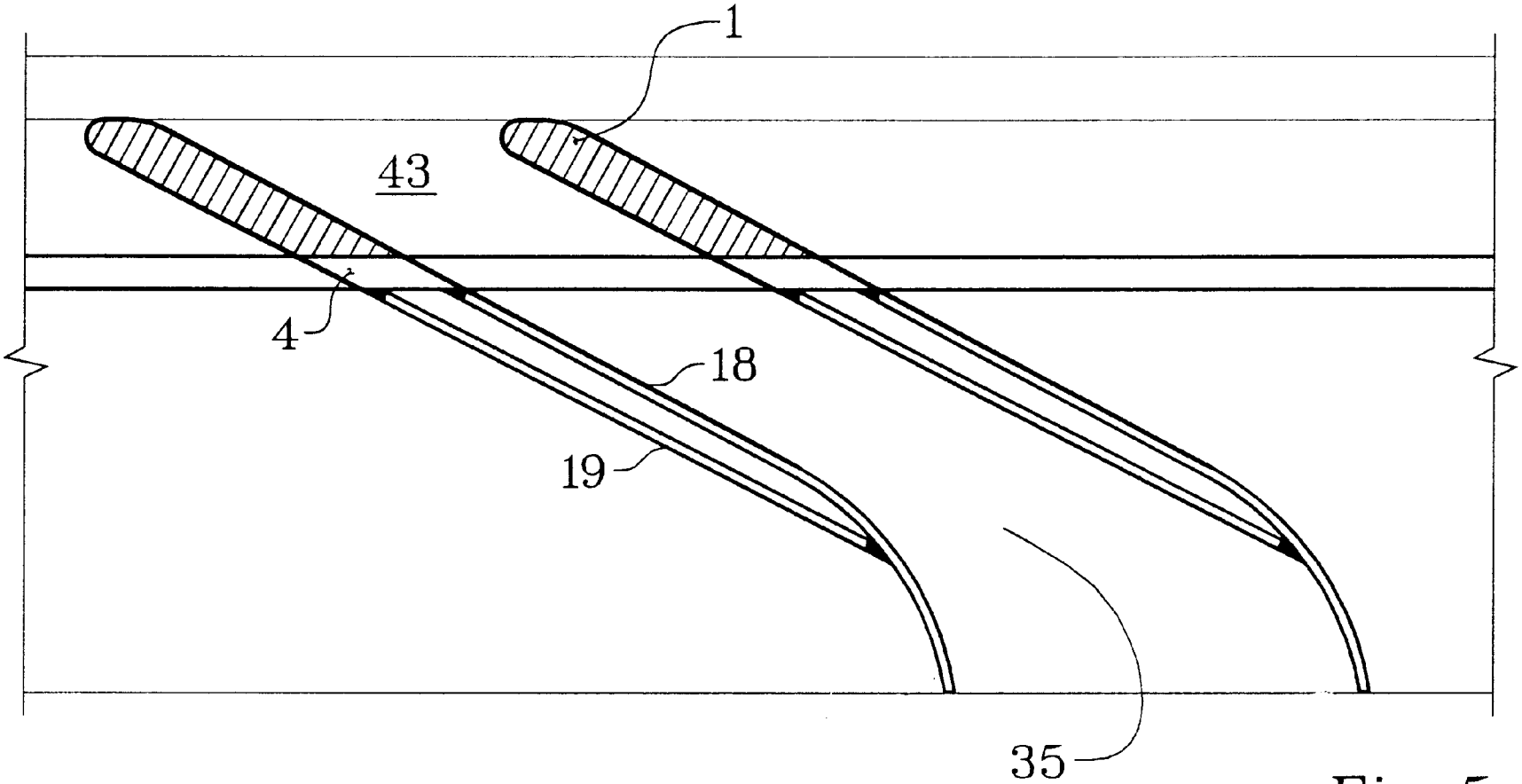
FIG. 5 is a side view of the vanes which are attached radially to the underside of the segment at each port.

FIG. 5 is a sectional view toward the inside of the throat assembly showing the vane construction, two vanes in particular, wherein reinforcement 19 is attached by welding to vane 18 to make a tapering passage. Pairs of vanes 18 and reinforcements 19 (acting as lower vanes) are attached by welding to the undersides of each of the air channel openings in the throat mounting ring 4 at angles of about 30 degrees from horizontal. The channel openings are arranged as shown in FIGS. 2 and 4 so that they match the port openings in the throat segments to form air channels 35 with smooth sides. In FIG. 5, rotation of the throat assembly is to the left, i.e. in the direction of rotation of the grinding table.

The length of the portion of air channel 35 which is below mounting ring 4 that is, the portion of air channel 35 defined by outer air inlet skirt 16, inner air inlet skirt 17, and vanes 18 is about twice the length, measured along outer air inlet skirt 16 as that from the mounting ring 4 to release point 36, but may be varied in length from about 1.8 to 2.2 times. Generally the length of the outside wall of air channel 35 below mounting ring 4 (defined also by vanes 18 and 19) will be about 1.8 to 2.2 times as long as that above mounting ring 4 (to the release point 36). And, air inlet skirt 17 (see FIG. 4) is curved to provide an air inlet 34 area generally about 5 to 6 times (preferably about 5.2 to 5.8 times) the area of release point 36 viewed as in FIG. 4.

As mentioned above, for the common size pulverizer with which the invention has been illustrated (Babcock & Wilcox type MPS, size 89, indicating that the pitch circle of the rolls where they contact the ring is 89 inches), the total area of all the release points 36 is normally in the range of 900 to 1600 square inches. The rated capacity of such prior art mills depends on the type of coal used—generally the capacity will be less for a hard coal than for a soft coal. The capacity of such a machine will range from 50 to 112 tons of coal per hour depending on the coal, but the ratio of air to coal will tend not to vary. The present invention, however, by reducing the total area of the release points of the air in air channels 35, and by creating an air channel 35 in the shape of a gradually converging nozzle with smooth sides, reduces the ratio of air to coal processed, and does so consistently with hard or soft coal regardless of the moisture content, and with large or small pulverizers. Thus, the relationship of the total area of the release points 36 to the capacity of the machine will be directly proportional to the nominal primary air volume for the machine, i.e. a throat for a machine with twice the coal processing capacity will have a total throat opening (total area of all release points 36) twice as large, and a machine with three times the coal processing capacity will have total throat openings 3 times larger.

I claim:

1. A segment for a pulverizer throat comprising a coal containment ring member, a channel-defining member defining at least one air channel including an upper release point, and a set of vanes attached to the lower end of each air channel, said vanes defining a lower opening for said air channel about five to about six times the area of said release point.

2. A rotatable throat for a coal pulverizer comprising a peripheral coal containment ring and a plurality of ring segments defining air channels having air intakes and release points said air intakes having an area about five to about six times the area of the release points thereof.

3. A rotatable throat of claim 2 including vanes attached underneath said coal containment ring to direct air into said air channels.

4. A rotatable throat of claim 2 mounted on a mounting ring.

5. A rotatable throat of claim 2 wherein the upper portions of said air channels are defined by ring segments including segments of said coal containment ring and the lower portions of said air channels are defined by radially flared vanes.

6. A rotatable throat assembly for a coal pulverizer having a coal processing capacity of about 50 to about 70 tons of coal per hour comprising (a) a mounting ring, and (b) a plurality of throat segments, each throat segment defining at least one air channel having a lower inlet opening and an upper release point, wherein the total area of the release points of all of said channels is 650 to 900 square inches and the total area of all the inlets is about five to about six times the total area of all of said release points.

7. A rotatable throat assembly of claim 6 having about 36 to about 48 air channels.

8. Method of modifying a roll-and-ring grinding mill having a circular throat for forcing air through a plurality of air ports comprising replacing said throat with a throat having air ports having release areas about one-fifth to one sixth the area of their intake areas.

* * * * *